US007688985B2

(12) United States Patent
Roeck

(10) Patent No.: US 7,688,985 B2
(45) Date of Patent: Mar. 30, 2010

(54) AUTOMATIC MICROPHONE MATCHING

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 1555 days.

(21) Appl. No.: 10/836,536

(22) Filed: Apr. 30, 2004

(65) Prior Publication Data

US 2005/0249359 A1 Nov. 10, 2005

(51) Int. Cl.
*H04R 3/00* (2006.01)

(52) U.S. Cl. ..... 381/92; 381/313; 381/95

(58) Field of Classification Search ..... 381/92, 381/95, 96, 103, 26, 122, 313, 104, 107
See application file for complete search history.

(56) References Cited

U.S. PATENT DOCUMENTS 5,224,170 A * 6/1993 Waite, Jr. ..... 381/92
5,515,445 A * 5/1996 Baumhauer et al. ..... 381/92
5,694,474 A * 12/1997 Ngo et al. ..... 381/66
6,002,776 A * 12/1999 Bhadkamkar et al. ..... 381/66
6,272,229 B1 * 8/2001 Baekgaard ..... 381/313
6,654,468 B1 * 11/2003 Thompson ..... 381/92
6,741,714 B2 * 5/2004 Jensen ..... 381/313
6,937,738 B2 * 8/2005 Armstrong et al. ..... 381/312
7,155,019 B2 * 12/2006 Hou ..... 381/92
2002/0176587 A1 11/2002 Roeck

FOREIGN PATENT DOCUMENTS

WO 02/30150 4/2002
WO 03/001560 A2 2/2003

* cited by examiner

*Primary Examiner*—Vivian Chin
*Assistant Examiner*—Jason R Kurr
(74) *Attorney, Agent, or Firm*—Pearne & Gordon LLP

(57) ABSTRACT

Signals dependent on the electrical output signals of two acoustical to electrical converters are computed to result in a result signal. A transfer characteristic between an acoustical signal impinging on the converters and the result signal is dependent on the arrival direction of the acoustical signals at the converters. The converters are matched for acoustical signals within a range of impinging arrival direction. The range of arrival directions is determined before matching.

27 Claims, 2 Drawing Sheets

AUTOMATIC MICROPHONE MATCHING

Figure 1:
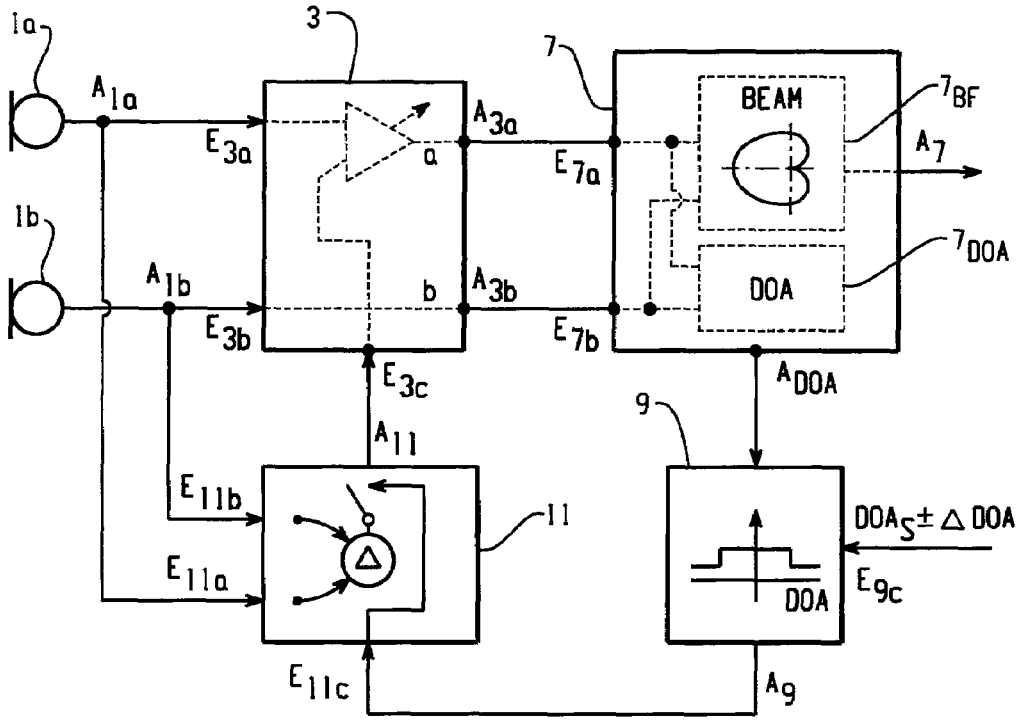

This Application has an Attachment A.

The present invention is directed on a method for matching at least two acoustical to electrical converters which generate, respectively, electrical output signals. Signals which depend on the electrical output signals of the converters are computed to result in a result signal. The transfer characteristic between an acoustical signal impinging upon the at least two converters and the result signal is dependent on direction of arrival—DOA—of the acoustical signal upon the at least two converters.

Acoustical pickup arrangements which have a transfer characteristic between acoustical input and electrical output, the amplification thereof being dependent on the DOA of acoustical signals on the acoustical inputs of such devices are called "beamformers" and are widely used as e.g. for hearing devices, be it outside-the-ear hearing devices or in-the-ear hearing devices, be it for such hearing devices to improve and facilitate normal hearing or be it for such hearing devices for therapeutic appliances, i.e. to improve hearing capability of hearing impaired persons. Further, beamformers may also be applied for hearing protection devices, whereat the main target is to protect an individual from excessive acoustical loads.

The addressed transfer characteristic, called the "beam" characteristic when represented in polar coordinates, is of one or more than one lobe and has accordingly one or more minima, called "Nulls", at specific values of DOA.

Beamformers may be conceived just by acoustical to electrical converters which per se have a beamforming characteristic.

The present invention deals with other cases where at least two spaced apart acoustical to electrical converters are used, signals dependent on their electrical output signals being computed to generate a result signal. It is by such computing that the desired beam characteristic is generated, between the acoustical input signals and the result signal. Often the at least two converters have omni-directional characteristics and it is only by the addressed computing that beamforming is achieved. Nevertheless, converters which have intrinsic beamforming ability may also be used but the desired transfer characteristic is conceived finally by the addressed computing.

Whenever a beam characteristic is realized by computing the electrical output signals of at least two acoustical to electrical converters or from more than two of such converters, whether a desired beam characteristic is accurately achieved depends from how accurately the involved converters provide for assumed predetermined transfer characteristics between their acoustical inputs and their electrical outputs.

DEFINITION

Two or more than two acoustical to electrical converters as microphones are considered to be matched if their real transfer characteristics between acoustical input signals and their electrical output signals is equal to such transfer characteristics as assumed when tailoring a desired beam characteristic.

Two or more than two of such converters are considered to be substantially matched if due to adjustment of at least one of their electrical output signals it is achieved that their respective real transfer characteristics are less different from the assumed transfer characteristic than they are without such adjustment, i.e. given just by the intrinsic behavior of the converters.

We understand under "marching" two or more than two acoustical to electrical converters, the process of mutually adjusting at least one characteristic feature of the transfer characteristic of at least one converter and so that the resulting real transfer characteristics of the at least two converters with the mutually adjusted electric output signals become less different from the assumed characteristics than they are without such adjustment. Characteristic features to be adjusted may e.g. be frequency response, thereby gain response and/or phase response. Thus, by the action of converter matching the converters become substantially matched, and not necessarily matched Often, the desired beam characteristic is designed based on the assumption of identical transfer characteristics of the converters involved. Obviously, in such case the converters are made to be matched if the real transfer characteristics between acoustical input signals and respective possibly mutually adjusted electrical output signals are identical.

In this case too the process of matching the converters means mutually adjusting their electrical output signals so that the respective real transfer characteristics differ less than without such mutual adjusting and become, due to the mutual adjustment, in the ideal case, identical.

As a most common example—known as "delay and subtract" technique—beamforming is performed using at least two e.g. omni-directional converters which are mutually spaced by a predetermined distance, mutually delaying the output signals of the converters and subtracting the mutually delayed electrical signals which results in an overall beam characteristic which, with omni-directional converters, is of cardoid, hypercardoid, bidirectional or some other shape. Directivity of the resulting beam characteristic depends on one hand from the mutual distance of the converters, on the other hand from the possibly adjustable, thereby often automatically adjustable mutual delay, and from the accuracy with which the converters are matched.

If the two addressed converters are not matched the desired transfer characteristic will only be reached approximately.

Attempts have been made to match the at least two converters by mutual converter specimen selection or by mutually adjusting their electrical output signals, be it statically or dynamically, i.e. during operation of the beamformer.

Recently, dynamic matching is the preferred approach which allows accounting for time-varying transfer characteristics.

According to the DE-OS-19 822 021, which accords with the U.S. Pat. No. 6,385,323, the electrical output signals of two microphone converters are fed via controlled matching amplifier units to a computing unit. The output signal of the computing unit has, with respect to acoustical input signals, a beam characteristic. The output signal powers resp. magnitudes of the matching amplifier units are averaged and the averaged signals compared by difference forming. The comparing result signal is fed to an analyzing and controller unit which controls the matching amplifier units. Thereby, the matching is performed in a negative feedback structure up to the comparing result of the two averaged signals vanishes. If this occurs the two input converters are considered to have been matched.

From the DE-OS-19 849 739 a similar approach as was discussed in context with the DE-OS 19 822 021 is known but in a feed-forwards structure. Significant characteristics as e.g. amplitude response or phase response of the analogue to digital converted output signals of two input converter microphones are compared and the output signal of one of the microphones is adjusted with respect to said characteristics as a function of the comparing result. It is further taught that whenever the two microphones have intrinsic beam characteristics directed in opposite directions, acoustical signals impinging laterally should lead to identical microphone output signals. Any deviation is then attributed to microphone mismatch and an appropriate adjustment is performed on the electric output signal of one of the microphones. Such ideal acoustical situation as only exploitable in free-field acoustical surrounding is apparently exploited for finding an appropriate optimum of pre-matching.

According to the WO 01/69968 the output signals of two microphones are computed. A result signal establishes with respect to the acoustical input signals a beamforming transfer characteristic. Each of the electrical output signals of the microphones is fed to a respective minimum estimation unit, the outputs thereof to a division unit. The result of the division controls a matching unit, namely a multiplying unit. It is recognized that because the microphones are often matched in free-field acoustical surrounding and not in-situ, the microphones can be mismatched when used in real life which degrades directionality. Matching is performed when the output signals of the microphones are minimal which is assigned to a "only noise" acoustical situation. This reference addresses multi-frequency band adaptive matching scheme.

From the EP 1 191 817 it is known to maintain a prevailing optimum directional transfer characteristic over time by forming a difference of averaged signals of the analog to digital converted microphone output signals and by feedback adjusting one of the digitalized microphone output signals to reduce the difference of the averaged signals.

In the U.S. Pat. No. 6,272,229 mismatch of the microphone converters with respect to phase is also discussed. It is taught to provide acoustical delay compensation at two microphone output signals, thereby trying to compensate for time delays between acoustical signals impinging on the two microphones. A remaining time delay—after acoustical delay compensation—between the two output signals is assigned to microphone phase mismatch.

The US 2001/0038699 teaches to disable the directivity of the transfer characteristic, i.e. the beam characteristic of a two-microphone-based beamformer whenever "only noise" situation is recognized, thereby disabling one of the two microphones to reduce overall noise and maintaining only one microphone operative.

According to the DE-PS 19 918 883 which accords with the U.S. Pat. No. 6,421,448 matching of two microphones is established with respect to frequency response by adjusting a filter arrangement between one of the microphone electrical outputs and a computing unit.

The present invention departs from the following recognitions:

Whenever a beamforming device or beamformer, which is based on at least two acoustical to electrical input converters, signals dependent on the output signals of these converters being computed, e.g. by delay-and-subtract operation, is applied in non-free field acoustical surrounding, such non-free field surrounding presents per se acoustical signal attenuation which varies as a function of spatial angle at which the acoustical source is seen from the acoustical input of the device. Such non-free field acoustical transfer characteristic, called "in-situ" characteristic, which varies with DOA is often important to be maintained as an informative entity. Generically, whenever according to known microphone matching approaches e.g. as described in the documents cited above, adjustment of the output signals of the converters is performed, this would lead—in the in-situ situation—to compensation of the in-situ transfer characteristic if fast time constants for the matching procedure were employed. Prior art literature like e.g. also U.S. Pat. No. 6,385,323 or U.S. Pat. No. 5,515,445 consider only aging, temperature, influence of dirt etc. as influencing factors for microphone matching though, i.e. they apply matching time constants in the range of minutes to days.

DEFINITION

By matching time constant we understand the adaptation time constant to adapt the converters involved from one matching situation to another matching situation.

In hearing device appliances the head-related transfer function HRTF provides for an acoustic in-situ transfer characteristic between an acoustical source and the at least two converters, which differs from individual to individual and which varies significantly with varying DOA. If a sound source is thought to travel on a circular locus around an individual's head, the in-situ transfer characteristic between the acoustical source and individual's ear may vary by more than 10 dB as a function of DOA. The individual exploits such DOA dependency for localizing acoustical sources. Thus, such characteristic should not be spoiled by converter matching.

Prior art microphone matching algorithms employing long matching time constants to guard against aging, dirt influences etc. will not be able to provide sufficient dynamic matching in dependency of DOA without negatively influencing also HRTF related localization by the user of the hearing device.

It is one object of the present invention to provide for a matching technique for the at least two acoustical to electrical converters which maintains the effect of acoustical, surrounding-based transfer characteristics—in-situ transfer characteristics—to the converters.

This is achieved by the method for matching at least two acoustical to electrical converters, wherein signals respectively dependent on electrical output signals of the converters are computed to result in a result signal, the transfer characteristic between an acoustical signal impinging upon said at least two converters and said result signal being dependent on DOA of said acoustical signal upon the at least two converters. The method comprises matching the at least two converters for acoustical signals in dependency of an impinging direction of arrival within a range of direction of arrival upon said converters, said range being determined before performing said matching.

Thereby, the range of DOA of acoustical signals for which matching is performed is selected so that the in-situ transfer characteristic is known and in advance, as an example, is known to be neglectable. Techniques to evaluate the DOA of acoustical signals impinging on at least two acoustical to electrical converters of a beamforming device are known.

With respect to evaluation of the DOA we refer as an example to the WO 00/33634 which accords with the U.S. patent application Ser. No. 10/180,585 of the same applicant as the present application. With respect to one possibility to monitor DOA the said WO 00/33634 as well as its US counterpart shall form by reference an integral part of the present application.

DOA evaluation is also strongly linked to time delay estimation for which numerous methods like cross-correlation, MUSIC, etc. are well known in the art. M. Brandstein "Microphone arrays", Springer, ISBN 3-540-41953-5 gives a nice overview over such methods. US 20010031053 shows another method for DOA estimation which is leaned on processes found in nature.

It has further been recognized that a range of DOA which is most suited to be exploited according to the present invention is where the desired transfer characteristic has minimum gain, i.e. around a "Null". This because signals impinging from the respective direction shall—according to the desired "Null"—be cancelled. Therefore, a realization form of the method according to the present invention, whereat the transfer characteristic has a minimum for a value of DOA, comprises matching the at least two converters for acoustical signals which impinge within the range determined before matching which includes such value of DOA.

Beamformers are further known which make use of at least two acoustical/electrical converters, signals dependent from their output signals being computed by a first computing and at least a second computing. The at least two computings result in respective first and second result signals. Thereby, a first transfer characteristic between an acoustical signal impinging on the at least two converters and the first result signal and which is dependent on DOA is differently dependent on DOA than a second transfer characteristic between the acoustical input signal and the second result signal. Such beamforming devices are e.g. realized by the so-called Griffith Jim-based beamformers as exemplified e.g. in the U.S. Pat. No. 5,473,701 to AT&T.

According to an embodiment of the present invention in such a case matching is performed independently for the addressed first and at least one second computing, for acoustical signals which respectively impinge from ranges of DOA determined before matching upon the at least two converters. These ranges may be selected to be equal or to be different.

In an embodiment of the present invention matching is performed selectively in frequency bands determined before matching, whereby in a further embodiment of the invention analog to digital and time-domain to frequency-domain conversion is performed between the electrical output of the at least two converters and computing.

Attention is drawn to the enclosed Attachment A which is a yet unpublished European patent application with application No. 04 006 073.3 filed Mar. 15, 2004 and which accords to a US application filed same date with a yet unknown Serial Number. This unpublished and therefore annexed patent application is to be considered as a part of the present description by reference with respect to the following subject matter:

In the Attachment A a method for suppressing feedback between an acoustical output of an electrical/acoustical output converter arrangement and an acoustical input of an acoustical/electrical input converter arrangement of a hearing device is addressed. Thereby, acoustical signals impinging on an input converter arrangement are converted into a first electrical signal by a controllably variable transfer characteristic which is dependent on the angle (DOA) at which the acoustical signals impinge on the input converter arrangement. The first electrical signal is then processed and a signal resulting from such processing is applied to the output converter.

Thus, and with an eye on the present description the following may be established:

The acoustical/electrical input converter arrangement as addressed in the Attachment A, wherein acoustical signals impinging on the input converter arrangement are converted into a first electrical signal by a controllably variable transfer characteristic which is dependent on the angle at which the acoustical signals impinge on the input converter arrangement, accords in the present description to the at least two acoustical to electrical converters, computing and generating the result signal.

When applying the device according to the present invention to hearing devices as addressed above, the result signal is operationally connected via a processing unit to an electrical/acoustical output converter arrangement. Further, the teaching according to the Attachment A addresses a method for suppressing feedback between the output of such electrical/acoustical output converter arrangement and the input of the at least two converters as addressed in the present description.

According to the present application as was already addressed the at least two input converters are to be matched during operation, i.e. automatically, whereby in fact the real transfer characteristic is adjusted. This accords with the definition in Attachment A of an adaptive beamformer unit.

If according to one embodiment of the present invention the result signal is operationally connected to an output electrical/acoustical converter as of a hearing device and there is provided, as described in the Attachment A in details, a feedback compensator, the input of which being operationally connected to the input of the output converter arrangement, the output of which being fed back, the complex task of estimating the feedback signal to be suppressed by the feedback compensator e.g. by correlation leads to the fact that the feedback compensation process has a relatively long adaptation time constant to adapt from one feedback situation to be suppressed to another by appropriately varying the loop gain of the feedback loop. As described in the Attachment A such an adaptation time constant is customarily in the range of hundreds of msec.

The matching process which is addressed in the present application defines as well for an adaptation time constant of the adaptive beamformer. The adaptation time constant for "matching adaptation" is significantly shorter than the adaptation time constant as realized by the feedback compensator. Therefore, and if according to one aspect of the present invention a feedback compensator is provided as explained in detail in the addressed Attachment A, the same problems arise as also explained in the addressed Attachment A, namely the problem that the feedback compensator may not follow quick changes of feedback situations which are caused by the short adaptation time constants of matching adaptation. Thus, and according to one aspect of the present invention, this is resolved by that embodiment of the present invention, wherein the addressed result signal is operationally connected to an electric input of an electrical to acoustical converter and which comprises feeding back an electric feedback compensating signal which is dependent on an input signal to the electrical to acoustical converter and superimposing the fed-back signal to the result signal, wherein further the adaptation rate of matching according to the present invention is controlled in dependency of the loop gain along the feedback signal path.

The skilled artisan will recognize also from the Attachment A or the respective applications once published, how to realize the just addressed embodiment of the invention.

As was addressed above prior art matching is accomplished with matching time constants $\tau$ which are very long, namely in the range of minutes up to days. Thereby, such matching may not cope with converter matching needs which arise at short term.

This is remedied by the present invention under a second aspect by providing for a method for matching at least two acoustical to electrical converters, signals dependent on the electrical output signals of the converters being computed to result in a result signal and wherein the transfer characteristic between an acoustical signal impinging upon the at least two converters and the result signal is dependent on direction of arrival of the acoustical signal on the at least two converters, wherein matching of the converters is performed with a matching time constant $\tau$, for which there is valid:

$0<\tau\leqq 5$ sec.

Thereby, in a further embodiment there is established $0<\tau\leqq 1$ sec.

And in a still further embodiment $0<\tau\leqq 100$ msec.

A beamforming device according to the present invention comprises at least two acoustical to electrical converters and at least one computing unit, the electrical output of the converters being operationally connected via a matching unit to inputs of the at least one computing unit. Thereby, the output of the beamforming device is operationally connected to the output of the at least one computing unit. The computing unit further generates a signal which is indicative of DOA of an acoustical signal which impinges on the at least two converters. The device further comprises a matching control unit which generates a matching control signal which is operationally connected to a control input of the matching unit. The signal which is indicative of DOA is further operationally connected to a control input of the matching control unit, which further has at least two inputs which are operationally connected to respective outputs of the at least two converters, in feedback structure downstream the matching unit, in feedforwards structure upstream the matching unit.

Under a second aspect of the present invention there is provided a beamforming device comprising at least two acoustical to electrical converters and at least one computing unit, the electrical output of said converter being operationally connected via a matching unit to inputs of said at least one computing unit, the output of said beamforming device being operationally connected to the output of said at least one computing unit, a matching control unit generating a matching control signal operationally connected to a control input of the matching unit, said matching unit comprising at least two inputs operationally connected to the outputs of said at least two converters upstream or downstream said matching unit and wherein said matching control unit generates the matching control signal so as to match the at least two converters with a matching time constant $\tau$ for which there is valid:

$0<\tau\leqq 5$ sec.

In a further embodiment under this second aspect the matching time constant $\tau$ is:

$0<\tau\leqq 1$ sec.

In a still further embodiment there is valid:

$0<\tau\leqq 100$ msec.

It is further to be noted that when we speak of a value or of a frequency band which is determined before matching is performed, the meaning of "before" encompasses a long time span before, e.g. when a respective device is fitted or even is manufactured up to a very short time span when such a value or frequency band is determined dynamically in situ just before the respective matching is performed.

Preferred embodiments of the present invention shall now be exemplified with the help of figures. These as well as the appending claims will also reveal to the skilled artisan additional embodiments of the device according to the invention.

Figure 2:
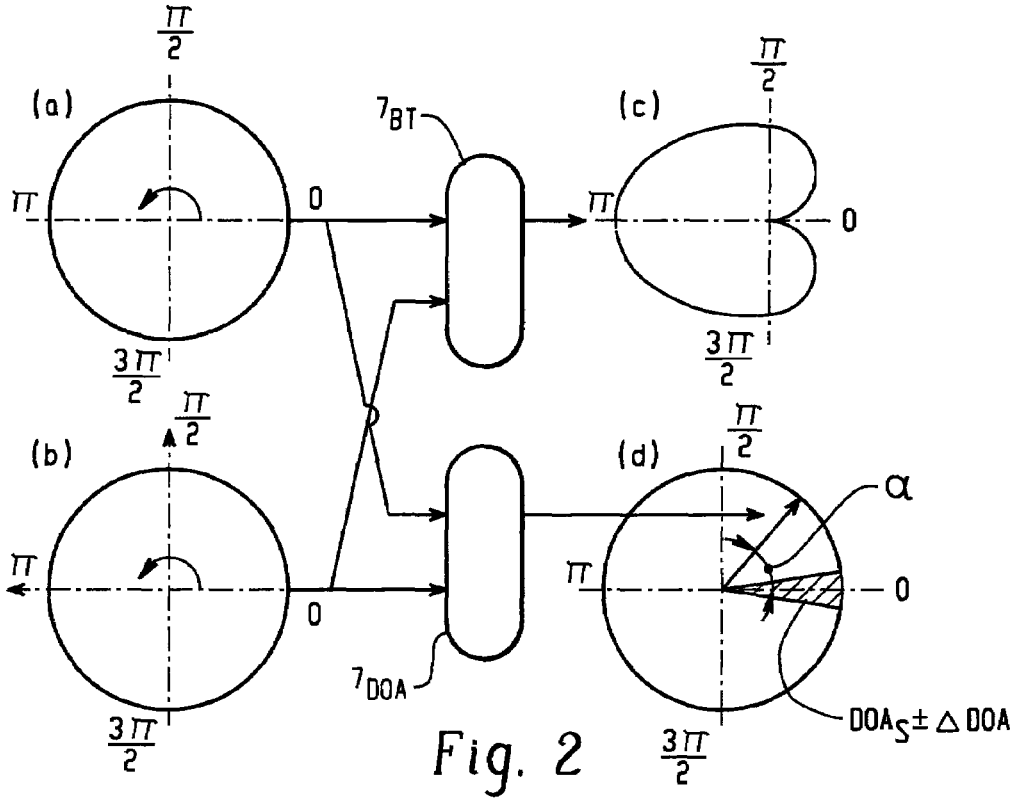
Figure 3:
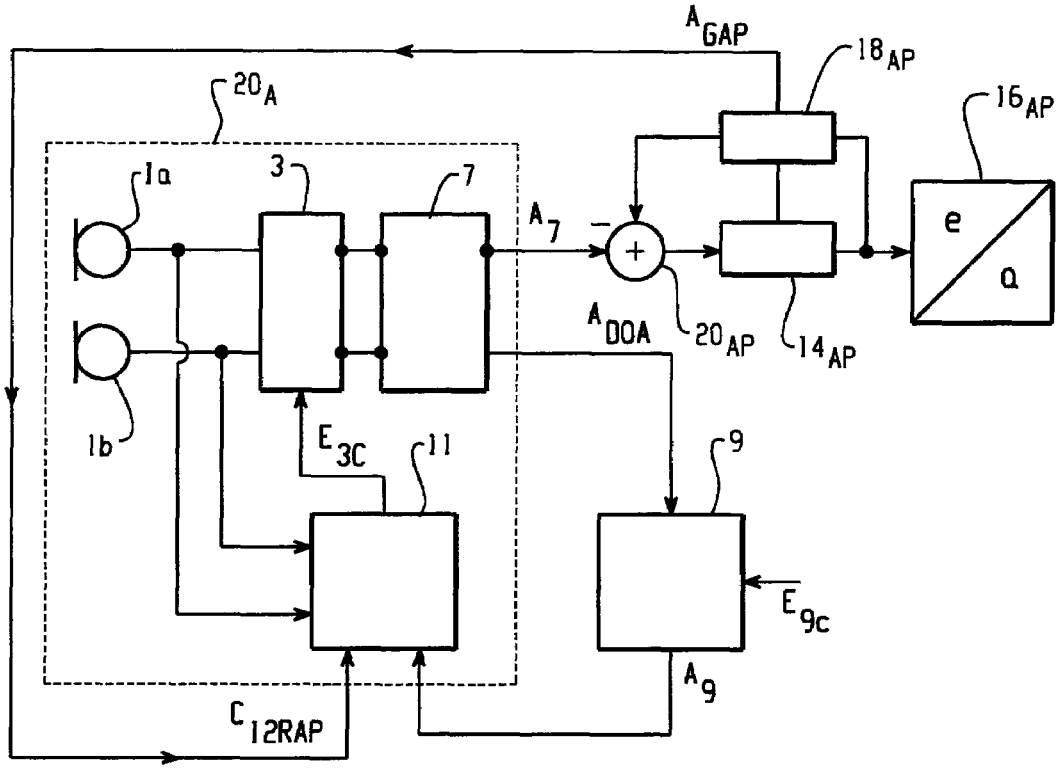
Figure 4:
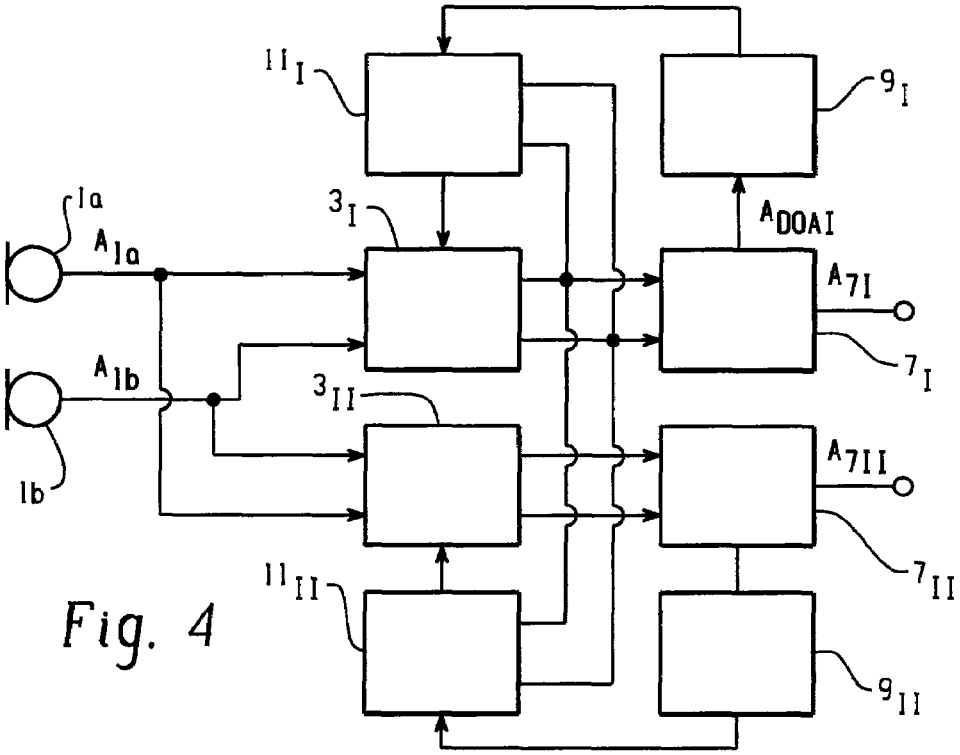

The figures show:

FIG. 1 schematically and simplified, by means of a signal-flow/functional block diagram, an embodiment of the device according to the present invention performing the method according to the invention;

FIG. 2 a schematic representation of steps as performed by the method and device according to FIG. 1;

FIG. 3 in a representation in analogy to that of FIG. 1, the implementation of the device of FIG. 1, e.g. in a hearing device as an embodiment of the invention with feedback compensation, and FIG. 4 a further embodiment of a device according to the present invention operating according to the method of the present invention, again in a representation in analogy to that of FIG. 1.

According to FIG. 1 a number of acoustical to electrical converters, as shown two such converters 1*a* and 1*b*, have electrical outputs $A_{1a}$, $A_{1b}$ which are operationally connected to inputs $E_{3a}$ and $E_{3b}$ of a matching unit 3. As shown in dashed lines within matching unit 3 signals which are applied to the inputs $E_{3a}$ and $E_{3b}$ are adjusted with respect to at least one of their characteristics, e.g. with respect to frequency response, amplitude and/or phase response or other characteristic features.

Respective adjusting members are provided in unit 3, e.g. as shown in channel a or b or in both channels a and b. The outputs $A_{3a}$ and $A_{3b}$ are operationally connected to inputs $E_{7a}$ and $E_{7b}$ of a computing unit 7 which has an output $A_7$ and an output $A_{DOA}$.

Within computing unit 7 on one hand and as schematically shown by unit $\mathbf{7}_{BF}$ beamforming is computed from the signals applied to the inputs $E_{7a}$, $E_{7b}$ e.g. by delay-and-subtract computing. The result of beamforming is fed to output $A_7$ as a result signal of the beamforming operation.

Additionally, in computing unit 7 the direction of arrival DOA of acoustical signals impinging upon the converters 1*a* and 1*b* is computed from the signals applied to $E_{7a}$, $E_{7b}$ resulting in an output signal fed to output $A_{DOA}$ of computing unit 7 which is indicative of DOA of the addressed acoustical signals. In unit $\mathbf{7}_{DOA}$ performing monitoring of the DOA is e.g. realized as described in the WO 00/33634 which was already mentioned above or as taught by the following publications:

M. Brandstein "Microphone arrays", Springer, ISBN 3-540-41953 or US 2001003053.

At the output $A_{DOA}$ of computing unit 7 there is generated a signal which is indicative of the direction of arrival DOA. This signal is operationally connected to a comparator unit 9, where it is checked, whether the instantaneously evaluated DOA signal is within a range $\pm\Delta$DOA around a value $DOA_S$. Determination, whether the actual DOA signal is within this range $DOA_S\pm\Delta DOA$ is performed by comparing the DOA indicative signal from the output $A_{DOA}$ with a signal range which is preset at input $E_{9C}$ of unit 9. Whenever it is detected in unit 9 that the prevailing DOA signal is within the predetermined range, unit 9 generates at an output $A_9$ a control signal which is operationally connected to a control input $E_{11c}$ of a matching control unit 11. The matching control unit 11 has two further inputs $E_{11a}$ and $E_{11b}$ which are operationally connected to the electric output $A_{1a}$ and $A_{1b}$ of the respective converters. The signals applied to the input $E_{11a}$ and $E_{11b}$ are compared as shown in block 11 e.g. by difference forming and an output signal is generated at output $A_{11}$ of matching control unit 11, which is dependent on the result of such comparison. As further schematically shown within unit 11 the signal applied to control input $E_{11c}$ enables the comparison result dependent signal to become effective via output $A_{11}$ on adjustment control input $E_{3c}$ of matching unit 3, controlling the adjustant members provided in matching unit 3. Thereby, as a function of the comparing result in matching control unit 11, the at least two signals which are fed to the computing unit 7 at $E_{7a}$ and $E_{7b}$ are adjusted to become less different.

Whereas FIG. 1 shows a feed forwards structure the same technique may be realized in a feed-back structure (not shown) by connecting the inputs $E_{11a}$ and $E_{11b}$ not to the outputs of the converters 1*a* and 1*b* upstream unit 3, but instead to the outputs $A_{3a}$ and $A_{3b}$ downstream matching unit 3.

In FIG. 2 processing as performed with the device and method exemplified with the help of FIG. 1 shall further be explained. Representation (a) shows as an example the transfer characteristic in polar representation of an omnidirectional converter as of converter 1*a* of FIG. 1. Representation (b) shows such transfer characteristic again as an example of the second converter as of 1*b* of FIG. 1. Based on these two converter-intrinsic omnidirectional transfer characteristics, beamforming within computing unit 7 leads e.g. to the cardoid transfer characteristic as shown in representation (c) which is e.g. realized by the delay-and-subtract method.

Within computing unit 7 and as shown in FIG. 1 by block $\mathbf{7}_{DOA}$, the instantaneously prevailing DOA is estimated as shown in representation (d) to be $\alpha$. The range, which is determined before performing matching, $DOA_S \pm \Delta DOA$ as also shown in representation (d) is exemplified with $DOA_S=0$, at which a "Null" of the desired transfer characteristic as of representation (c) is expected. Only then when the estimated DOA according to $\alpha$ is within the range $DOA_S \pm \Delta DOA$, with an eye on FIG. 1, matching of the converters is initiated by means of the signal generated at the input $E_{11c}$. Techniques which are applicable for mutually adjusting the signals in matching unit 3 are well-known as has been shown by the referenced publications in the introductory part of the present description. Accordingly, the matching control unit 11 is realized to provide for the desired dependency between the comparison result of comparing the signals applied to the inputs $E_{11a}$ and $E_{11b}$ and adjustment of the respective adjusting members in unit 3.

Instead of enabling/disabling, practically in a hard switching manner, matching of the converters via matching control unit 11 it is possible to softly weigh the effect of the comparing result computed in matching control unit 11 upon the adjusting members in matching 3 e.g. as a function of deviation between estimated DOA and $DOA_S$ as determined before performing matching. Such weighing may e.g. be realized so that such effect becomes the weaker resp. the matching frozen the more that the estimated DOA deviates from $DOA_S$.

In FIG. 3 a further embodiment of a device according to the present invention operating according to the method of the invention is shown. The same reference numbers are used in FIG. 3 as in FIG. 1 for elements which have already been described in context with FIG. 1.

The unit comprising the converters 1*a*, 1*b*, matching unit 3, computing unit 7, matching control unit 11, provides for an adaptive beamformer unit $\mathbf{20}_A$, whereby being adapted by adjusting the overall transfer function by converter matching.

The output $A_7$ of the adaptive beamformer $\mathbf{20}_A$ is operationally connected to a superimposing unit $\mathbf{20}_{AP}$.

Attention is drawn to the convention with respect to the reference numbers applied in FIG. 3. The same reference numbers are used as used in the Attachment A, FIG. 3, which latter teaches in more details the technique as also applied in the embodiment of FIG. 3 of the present invention. Nevertheless, these linking reference numbers are indexed with "AP" (for Appendix).

The output of the superimposing unit $\mathbf{20}_{AP}$ is input to processing unit $\mathbf{14}_{AP}$, the output thereof being operationally connected to the input of an electrical to acoustical converter arrangement $\mathbf{16}_{AP}$. Thereby, the combined structure of beamformer 20A, processing unit $\mathbf{14}_{AP}$ and electrical to acoustical converter arrangement $\mathbf{16}_{AP}$ is a structure typical e.g. in hearing device applications.

A compensator unit $\mathbf{18}_{AP}$ has an input operationally connected to the input of the converter arrangement $\mathbf{16}_{AP}$ and an output operationally connected to one input of the superimposing unit $\mathbf{20}_{AP}$. The negative feedback loop with compensator unit $\mathbf{18}_{AP}$ provides for compensation of acoustical feedback from the acoustical output of converter arrangement $\mathbf{16}_{AP}$ to the acoustical input of the converters 1*a*, 1*b*.

As schematically shown in FIG. 3 the compensator unit $\mathbf{18}_{AP}$ has an output $A_{GAF}$, whereat a signal is generated which is indicative of the loop gain of the negative feedback loop. This loop gain may e.g. be estimated by multiplying the linear gains along the loop which primarily consists of the compensator unit 18 and of processing unit $\mathbf{14}_{AP}$ or by adding these gains in dB.

The loop gain indicative signal at output $A_{GAP}$ is fed to a control input $C_{12RAP}$ of the adaptive beamformer $\mathbf{20}_A$ and therein to a control input of matching control unit 11. By means of the loop gain indicative signal applied to this control input, the matching adaptation rate at matching unit 3 and via matching control unit 11 is slowed down at least down to the adaptation rate of compensator unit $\mathbf{18}_{AP}$ in dependency of the prevailing feedback effect and thus of the loop gain of compensator unit $\mathbf{18}_{AP}$. Thereby, combination of the beamformer unit 20A with automatically matched converters 1*a* and 1*b* according to the present invention and of feedback compensation becomes feasible.

In FIG. 4 a further embodiment of the present invention is shown. Again, reference numbers which were already used in context with FIG. 1 or 3 are used for elements which have already been described. According to the embodiment of FIG. 4 the outputs $A_{1a}$ and $A_{1b}$ of the at least two converters 1*a* and 1*b* are operationally connected to a first matching unit $\mathbf{3}_I$ and to a second matching unit $\mathbf{3}_{II}$.

The outputs of the two matching units $\mathbf{3}_I$ and $\mathbf{3}_{II}$ are operationally connected to respective computing units $\mathbf{7}_I$ and $\mathbf{7}_{II}$. At the output $A_{7I}$ there appears a first result signal. Between an acoustical input signal impinging on the converters 1*a* and 1*b* and the first result signal at output $A_{7I}$ there prevails a first transfer characteristic which is differently dependent on DOA than a second transfer characteristic which prevails between the acoustical input signal upon converters 1*a* and 1*b* and a signal generated at output $A_{7II}$ of the second computing unit $\mathbf{7}_{II}$.

Thus, in fact based on the converters 1*a* and 1*b* two beamformers are realized with different beam characteristics. Matching is performed independently at both beamformers as follows:

Matching of the converters with respect to first beamformer I is performed via unit $\mathbf{9}_I$, matching control unit $\mathbf{11}_I$ in analogy to the one beamformer technique of FIG. 1. Further in complete analogy matching of the converters 1*a* and 1*b* with respect to the second beamformer II is performed via unit $\mathbf{9}_{II}$, matching control unit $\mathbf{11}_{II}$. As may be seen in FIG. 4 in opposition to the representation in FIG. 1 a feedback structure is shown in that the outputs of the respective matching units $\mathbf{3}_I$ and $\mathbf{3}_{II}$ are fed for comparison purposes to the matching control units $\mathbf{11}_I$ and $\mathbf{11}_{II}$.

In all the embodiments of the invention signal processing may be performed in analog or digital or hybrid technique. Converter matching selectively in frequency bands which are determined before performing matching is simplified by signal processing in the frequency domain.

Due to the fact that according to the one aspect of the present invention converter matching is only then performed when an acoustical signal impinges on the input converters within a range of DOA and this range may be selected in an optimum direction with an eye on in-situ situation, it is achieved that automatic in-situ converter matching is feasible without affecting the effects of the in-situ acoustic situation.

As was already addressed above generically matching time constants for direction of arrival controlled matching as was described with the help of FIGS. 1 to 4 may be performed with a matching time constant $\tau$ for which there is valid:

$$0<\tau\leqq 5 \text{ sec.}$$

Thereby, such time constant $\tau$ may be even selected to be:

$$0<\tau\leqq 1 \text{ sec.}$$

or even to be $$0<\tau\leqq 100 \text{ msec.}$$

Nevertheless and irrespectively of controlling converter matching in dependency of direction of arrival, more generically, a beamformer technique is addressed under a second aspect which makes use of at least two acoustical to electrical converters and where converter matching is performed with matching time constants $\tau$ for which the addressed ranges are valid.

The invention claimed is:

1. A method for matching at least two acoustical to electrical converters generating each an electrical output signal, wherein signals which are dependent on the electrical output signals of said converters are computed to result in a result signal, and wherein a transfer characteristic between acoustical signals impinging upon said at least two converters and said result signal has an amplification which is dependent on direction of arrival of said acoustical signals on said at least two converters, comprising the steps of matching said converters whenever an impinging direction of arrival of said acoustical signals is within a range of directions predetermined before performing said matching, said matching being performed under consideration of respective transfer characteristics from an acoustical source emitting said acoustical signals to respective ones of said at least two acoustical to electrical converters.

2. The method of claim 1, said transfer characteristic having a minimum of amplification for a value of direction of arrival, and comprising the steps of matching said at least two converters for acoustical signals impinging within said range including said value.

3. The method of claim 1, wherein said dependent signals are first computed to result in a first of said result signals and are second computed to result in a second of said result signals, and wherein there is established a first transfer characteristic between an acoustical signal impinging upon said at least two converters and said first result signal, said first transfer characteristic having a first dependency of amplification from said direction of arrival, and there further established a second transfer characteristic between an acoustical signal impinging upon said at least two converters and said second result signal, said second transfer characteristic having a second dependency of amplification from said direction of arrival, and wherein said dependency of said first transfer characteristic is different from said dependency of said second transfer characteristic, and further performing said matching independently at said first computing and said second computing.

4. The method of claim 1, further comprising performing said matching selectively in frequency bands determined before said matching.

5. The method of claim 1, further comprising performing an analog to digital and a time-domain to frequency-domain conversion downstream from said converters.

6. The method of claim 1, wherein said result signal is operationally connected to an electric input of an electrical to acoustical converter comprising feeding back, an electric feedback compensating signal dependent on an input signal to said electrical to acoustical converter and superimposing said fed back signal to said result signal, controlling adaptation rate of said matching in dependency of the loop gain along the feedback signal path of said electric feedback compensating signal.

7. The method of claim 1, further comprising performing said matching with a matching time constant $\tau$ for which there is valid: $0<\tau\leqq 5$ sec.

8. The method of claim 1, further comprising performing said matching with a matching time constant $\tau$ for which there is valid: $0<\tau\leqq 1$ sec.

9. The method of claim 1, further comprising performing said matching with a matching time constant $\tau$ for which there is valid: $0<\tau\leqq 100$ msec.

10. A method for matching the operation of at least two acoustical to electrical converters comprising the steps of:

converting acoustical signals impinging upon a first of said at least two acoustical to electrical converters into a first electrical signal by a first transfer function;

converting acoustical signals impinging upon a second of said at least two acoustical to electrical converters into a second electrical signal by a second transfer function;

computing from a third electrical signal which is dependent on said first electrical signal and from a fourth electrical signal which is dependent on said second electrical signal a result signal which is dependent on direction of arrival of said acoustical signals upon said first and said second acoustical to electrical converters;

said matching being performed by periodically adjusting at least one of said first and of said second transfer functions to be different only by a predetermined amount at a time rate $\tau$ of $0<\tau\leqq 5$ sec.

wherein said matching is performed whenever the direction of arrival of said acoustical signals is within a range of directions predetermined before performing said matching.

11. A method for matching the operation of at least two acoustical to electrical converters comprising the steps of:

converting acoustical signals impinging upon a first of said at least two acoustical to electrical converters into a first electrical signal by a first transfer function;

converting acoustical signals impinging upon a second of said at least two acoustical to electrical converters into a second electrical signal by a second transfer function;

computing from a third electrical signal which is dependent on said first electrical signal and from a fourth electrical signal which is dependent on said second electrical signal a result signal which is dependent on direction of arrival of said acoustical signals upon said first and said second acoustical to electrical converters;

said matching being performed by periodically adjusting at least one of said first and of said second transfer functions to be different only by a predetermined amount at a time rate $\tau$ of $0<\tau\leqq 1$ sec., wherein said matching is performed whenever the direction of arrival of said acoustical signals is within a range of directions predetermined before performing said matching.

12. A method for matching the operation of at least two acoustical to electrical converters comprising the steps of:

converting acoustical signals impinging upon a first of said at least two acoustical to electrical converters into a first electrical signal by a first transfer function;

converting acoustical signals impinging upon a second of said at least two acoustical to electrical converters into a second electrical signal by a second transfer function;

computing from a third electrical signal which is dependent on said first electrical signal and from a fourth electrical signal which is dependent on said second electrical signal a result signal which is dependent on direction of arrival of said acoustical signals upon said first and said second acoustical to electrical converters;

said matching being performed by periodically adjusting at least one of said first and of said second transfer functions to be different only by a predetermined amount at a time rate $\tau$ of $0<\tau\leqq 100$ msec., wherein said matching is performed whenever the direction of arrival of said acoustical signals is within a range of directions predetermined before performing said matching.

13. A beamforming device comprising at least two acoustical to electrical converters and at least one computing unit, the electrical outputs of said converters being operationally connected via a matching unit to inputs of said at least one computing unit, the output of said beamforming device being operationally connected to the output of said at least one computing unit, said computing unit generating a signal indicative of direction of arrival of an acoustical signal impinging on said at least two converters, a matching control unit generating a matching control signal operationally connected to a control input of said matching unit, said signal indicative of direction being operationally connected to a control input of said matching control unit, said matching control unit comprising at least two inputs operationally connected to the outputs of said at least two converters upstream or downstream said matching unit, said matching control unit comprising a determination unit determining whether said signal indicative of direction is within a predetermined range of directions.

14. The beamforming device of claim 13, further comprising an electrical to acoustical converter, the output of said computing unit being operationally connected to an input of said electrical to acoustical converter, further comprising a feedback compensator unit, the input thereof being operationally connected to said input of said electrical to acoustical converter, an output thereof being operationally connected and superimposed to the output of said computing unit, said feedback compensator unit having an output for a loop gain indicative signal being operationally connected to a control input of said matching control unit.

15. The device of claim 13 being part of a hearing device.

16. The device of claim 15, wherein said hearing device is an outside-the-ear hearing device or an in-the-ear hearing device.

17. The device of claim 15, wherein said hearing device is a hearing improvement device, a hearing aid device or a hearing protection device.

18. The beamforming device according to claim 13, said matching control unit generating said matching control signal to control said matching with a matching time constant $\tau$ for which there is valid: $0<\tau\leqq 5$ sec.

19. The beamforming device of claim 13, said matching control unit generating said matching control signal to control said matching with a matching time constant $\tau$ for which there is valid: $0<\tau\leqq 1$ sec.

20. The beamforming device of claim 13, said matching control unit generating said matching control signal to control said matching with a matching time constant $\tau$ for which there is valid: $0<\tau\leqq 100$ msec.

21. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, and wherein electrical outputs of said converters are operationally connected via a matching unit to inputs of said at least one computing unit, the output of said beamforming device being operationally connected to the output of said at least one computing unit, a matching control unit generating a matching control signal operationally connected to a control input of said matching unit, said matching control unit comprising at least two inputs operationally connected to the electrical outputs of said at least two converters upstream or downstream said matching unit, said matching control unit generating said matching control signal to control said matching, the matching unit matching said at least two acoustical to electrical converters by periodically adjusting at least one of said first and said second transfer functions at a time rate $\tau$ of $0<\tau\leqq 5$ sec, wherein the beamforming device is included in a hearing device adapted to be worn at least an ear of an individual, and wherein said matching is performed whenever an impinging direction of arrival of said acoustical signals is within a range of directions predetermined before performing said matching.

22. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, and wherein electrical outputs of said converters are operationally connected via a matching unit to inputs of said at least one computing unit, the output of said beamforming device being operationally connected to the output of said at least one computing unit, a matching control unit generating a matching control signal operationally connected to a control input of said matching unit, said matching control unit comprising at least two inputs operationally connected to the electrical outputs of said at least two converters upstream or downstream said matching unit, said matching control unit generating said matching control signal to control said matching, the matching unit matching said at least two acoustical to electrical converters by periodically adjusting at least one of said first and said second transfer functions at a time rate $\tau$ of $0<\tau\leqq 1$ sec, wherein the beamforming device is included in a hearing device adapted to be worn at least an ear of an individual, and wherein said matching is performed whenever an impinging direction of arrival of said acoustical signals is within a range of directions predetermined before performing said matching.

23. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, and wherein electrical outputs of said converters are operationally connected via a matching unit to inputs of said at least one computing unit, the output of said beamforming device being operationally connected to the output of said at least one computing unit, a matching control unit generating a matching control signal operationally connected to a control input of said matching unit, said matching control unit comprising at least two inputs operationally connected to the electrical outputs of said at least two converters upstream or downstream said matching unit, said matching control unit generating said matching control signal to control said matching, the matching unit matching said at least two acoustical to electrical converters by periodically adjusting at least one of said first and said second transfer functions at a time rate $\tau$ of $0<\tau\leqq 100$ msec, wherein the beamforming device is included in a hearing device adapted to be worn at least an ear of an individual, and wherein said matching is performed whenever an impinging direction of arrival of said acoustical signals is within a range of directions predetermined before performing said matching.

24. A beamforming device comprising at least two acoustical to electrical converters and at least one computing unit, the electrical outputs of said converters being operationally connected to inputs of said at least one computing unit, the output of said beamforming device being operationally connected to the output of said at least one computing unit, further comprising means for generating a signal indicative of direction of arrival of an acoustical signal impinging on said converters, further comprising means for performing matching of said at least two acoustical to electrical converters, said means for matching being controlled in dependency whether said signal indicative of said direction of arrival indicates said direction of arrival being within a predetermined range.

25. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, further comprising means for generating a signal indicative of direction of arrival of an acoustical signal impinging on said converters, further comprising means for matching said at least two acoustical to electrical converters by periodically adjusting at least one of said first and said second transfer functions at a time rate $\tau$ of $0<\tau\leqq 5$ sec, said means for matching being controlled in dependency whether said signal indicative of said direction of arrival indicates said direction of arrival being within a predetermined range, wherein the beamforming device is included in a hearing device adapted to be worn at least an ear of an individual.

26. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, further comprising means for generating a signal indicative of direction of arrival of an acoustical signal impinging on said converters, further comprising means for matching said at least two acoustical to electrical converters by periodically adjusting at least one of said first and said second transfer functions at a time rate $\tau$ of $0<\tau\leqq 1$ sec, said means for matching being controlled in dependency whether said signal indicative of said direction of arrival indicates said direction of arrival being within a predetermined range, wherein the beamforming device is included in a hearing device adapted to be worn at least an ear of an individual.

27. A beamforming device comprising at least two acoustical to electrical converters and at least one computing unit, wherein acoustical signals impinging upon a first of said at least two acoustical to electrical converters are converted into a first electrical signal by a first transfer function and acoustical signals impinging upon a second of said at least two acoustical to electrical converters are converted into a second electrical signal by a second transfer function, further comprising means for generating a signal indicative of direction of arrival of an acoustical signal impinging on said converters, further comprising means for matching said at least two acoustical to electrical converters by periodically adjusting at least one of said first and said second transfer functions at a time rate $\tau$ of $0<\tau\leqq 100$ msec, said means for matching being controlled in dependency whether said signal indicative of said direction of arrival indicates said direction of arrival being within a predetermined range, wherein the beamforming device is included in a hearing device adapted to be worn at least an ear of an individual.

* * * * *

UNITED STATES PATENT AND TRADEMARK OFFICE

CERTIFICATE OF CORRECTION

PATENT NO. : 7,688,985 B2
APPLICATION NO. : 10/836536
DATED : March 30, 2010
INVENTOR(S) : Hans-Ueli Roeck It is certified that error appears in the above-identified patent and that said Letters Patent is hereby corrected as shown below:

On the Title page, under the abstract, replace "27 Claims, 2 Drawing Sheets" with -- 27 claims, 5 Drawing Sheets --

Column 10, line 14, replace "$A_{GAF}$" with -- $A_{GAP}$ --

Signed and Sealed this

Twenty-eighth Day of September, 2010

David J. Kappos

David J. Kappos
*Director of the United States Patent and Trademark Office*